US010568398B2

(12) United States Patent
Harris et al.

(10) Patent No.: US 10,568,398 B2
(45) Date of Patent: Feb. 25, 2020

(54) RECONFIGURABLE STORAGE DEVICE

(71) Applicant: ACCO Brands Corporation, Lake Zurich, IL (US)

(72) Inventors: Richard H. Harris, Xenia, OH (US); Noah E. Dingler, Phoenixville, PA (US); Patrick B. Nolan, Royersford, PA (US); Andrew Toth, Schwenksville, PA (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/155,443

(22) Filed: Oct. 9, 2018

(65) Prior Publication Data

US 2019/0037987 A1 Feb. 7, 2019

Related U.S. Application Data

(62) Division of application No. 14/932,141, filed on Nov. 4, 2015, now Pat. No. 10,165,837.
(Continued)

(51) Int. Cl.
*A45F 3/04* (2006.01)
*A45C 3/02* (2006.01)
(Continued)

(52) U.S. Cl.
CPC ..... *A45C 3/02* (2013.01); *A45C 13/30* (2013.01); *A45F 3/02* (2013.01); *A45F 3/04* (2013.01);
(Continued)

(58) Field of Classification Search
CPC ..... A45C 2009/007; A45C 15/00; A45F 4/02; A45F 3/02; A45F 3/047; A45F 3/14; A45F 2003/142; A45F 2003/023
See application file for complete search history.

(56) References Cited

U.S. PATENT DOCUMENTS 294,622 A 3/1884 Höninger
1,370,636 A 3/1921 Dwyer
(Continued)

FOREIGN PATENT DOCUMENTS

WO 2007/127406 11/2007

OTHER PUBLICATIONS https://www.quora.com/What-are-carabiner-keychains-useful-for Christopher VanLang; (Jan. 24, 2012).

*Primary Examiner* — Adam J Waggenspack
(74) *Attorney, Agent, or Firm* — Fitch, Even, Tabin & Flannery LLP

(57) ABSTRACT

A binder device including a body having a first cover and a second cover directly or indirectly pivotally coupled together and at least partially defining an inner compartment therebetween. The body further includes a binding mechanism positioned in the inner compartment, a first body securing device coupled to the body, and a second body securing device coupled to the body. The binder device includes a strap including first and second strap segments. The strap is movable between a first configuration wherein the first and second strap segments are releasably coupled together to form a continuous strap that is wearable over a shoulder of a user, and a second configuration wherein the first strap segment is releasably coupled the first body securing device and the second strap segment is releasably coupled to the second body securing device such that the first and second strap segments each at least partially defines a loop. Each loop is shaped and configured to receive an arm of a user therethrough such that the binder device is wearable on a back of the user in the manner of a backpack. Each strap segment is configured to be releasably coupled to only one of the first or second body securing devices.

20 Claims, 8 Drawing Sheets

Related U.S. Application Data

(60) Provisional application No. 62/074,914, filed on Nov. 4, 2014.

(51) Int. Cl.

| | |
|---|---|
| ***A45F 3/02*** | (2006.01) |
| ***A45F 4/00*** | (2006.01) |
| ***A45C 13/30*** | (2006.01) |
| *A45C 9/00* | (2006.01) |
| *A45F 4/02* | (2006.01) |

(52) U.S. Cl.

CPC ..... *A45F 4/00* (2013.01); *A45C 2009/007* (2013.01); *A45F 2004/023* (2013.01)

(56) References Cited

U.S. PATENT DOCUMENTS

| | | | | |
|---|---|---|---|---|
| 5,285,833 | A * | 2/1994 | Haxby | A45C 1/04 150/102 |
| 5,577,652 | A | 11/1996 | Cooper | |
| 5,769,295 | A * | 6/1998 | Alves | A45F 3/02 224/578 |
| 6,138,882 | A | 10/2000 | Buettner | |
| 6,161,979 | A | 12/2000 | Yamamoto et al. | |
| 6,354,477 | B1 * | 3/2002 | Trummer | A45C 3/02 224/153 |
| 6,460,746 | B1 * | 10/2002 | Amram | A45F 3/047 224/579 |
| 6,474,523 | B2 * | 11/2002 | Morrison | A45F 3/02 224/197 |
| 6,626,601 | B1 | 9/2003 | Moor et al. | |
| 6,666,363 | B2 | 12/2003 | Godshaw et al. | |
| 7,387,226 | B2 | 6/2008 | Porter | |
| 8,113,399 | B2 | 2/2012 | Lee | |
| 9,016,449 | B1 * | 4/2015 | Soboyejo | A45C 5/00 150/106 |
| 2004/0065708 | A1 | 4/2004 | Amram | |
| 2004/0089687 | A1 | 5/2004 | Ammerman | |
| 2007/0086845 | A1 * | 4/2007 | Merzon | A45C 3/02 402/73 |
| 2008/0035693 | A1 | 2/2008 | Lee | |
| 2010/0213224 | A1 | 8/2010 | Barr | |
| 2012/0261445 | A1 | 10/2012 | Demskey | |
| 2013/0292441 | A1 | 11/2013 | Shen | |

* cited by examiner

RECONFIGURABLE STORAGE DEVICE

This application is a divisional of U.S. patent application Ser. No. 14/932,141, filed on Nov. 4, 2015, now issued as U.S. Pat. No. 10,165,837, which in turn claims priority to U.S. Provisional Patent Application Ser. No. 62/074,914, filed on Nov. 4, 2014. The entire contents of both of those applications are hereby incorporated by reference.

The present invention is directed to a storage device, and more particularly, to a storage device with a strap that can be variously configured.

BACKGROUND

Storage bags or devices, such as binders, pouches, bags, pockets, briefcases and the like are used to store a variety of components. The storage devices may include an inner compartment in which components may be stored, and a handle or carrying strap. However, existing bags may not provide reconfiguration capabilities such that the bag can be carried in various manners.

SUMMARY

In one embodiment, the present invention is a binder device including a body having a first cover and a second cover directly or indirectly pivotally coupled together and at least partially defining an inner compartment therebetween. The body further includes a binding mechanism positioned in the inner compartment, a first body securing device coupled to the body, and a second body securing device coupled to the body. The binder device includes a strap including first and second strap segments. The strap is movable between a first configuration wherein the first and second strap segments are releasably coupled together to form a continuous strap that is wearable over a shoulder of a user, and a second configuration wherein the first strap segment is releasably coupled the first body securing device and the second strap segment is releasably coupled to the second body securing device such that the first and second strap segments each at least partially defines a loop. Each loop is shaped and configured to receive an arm of a user therethrough such that the binder device is wearable on a back of the user in the manner of a backpack. Each strap segment is configured to be releasably coupled to only one of the first or second body securing devices.

DETAILED DESCRIPTION

Figure 1:
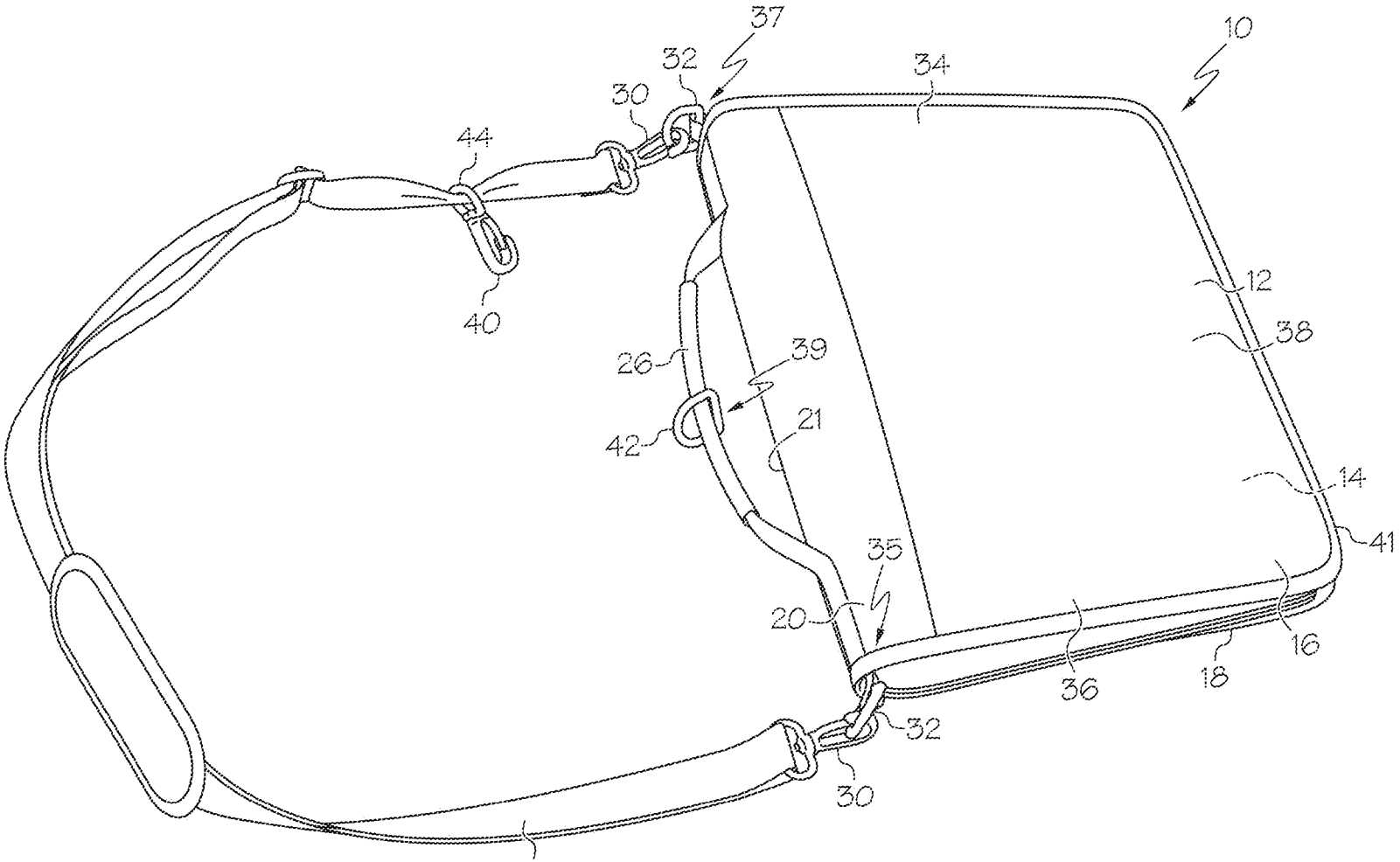
FIG. 1 is a front perspective view of one embodiment of the storage device in its closed position with the strap in a first configuration.

As shown in FIGS. 1-9, the storage device of the present invention, generally designated 10 or 10', can include a generally rectangular prism-shaped body or outer casing 12 having an inner compartment 14. The casing 12 can include a first or front cover or panel 16, a second or back cover or panel 18, and spine 20 positioned therebetween. The front cover 16 and back cover 18 may pivotally coupled along an associated hinge or fold line(s) 21 or areas. In one case a hinge line 21 is positioned on each side of the spine 20 and/or the entire spine 20 can be considered a fold area 21. It should be further understood that the storage device 10 need not necessarily include the spine 20, in which case panels 16, 18 can be directly pivotally coupled to each other along a single hinge line 21.

Figure 2:
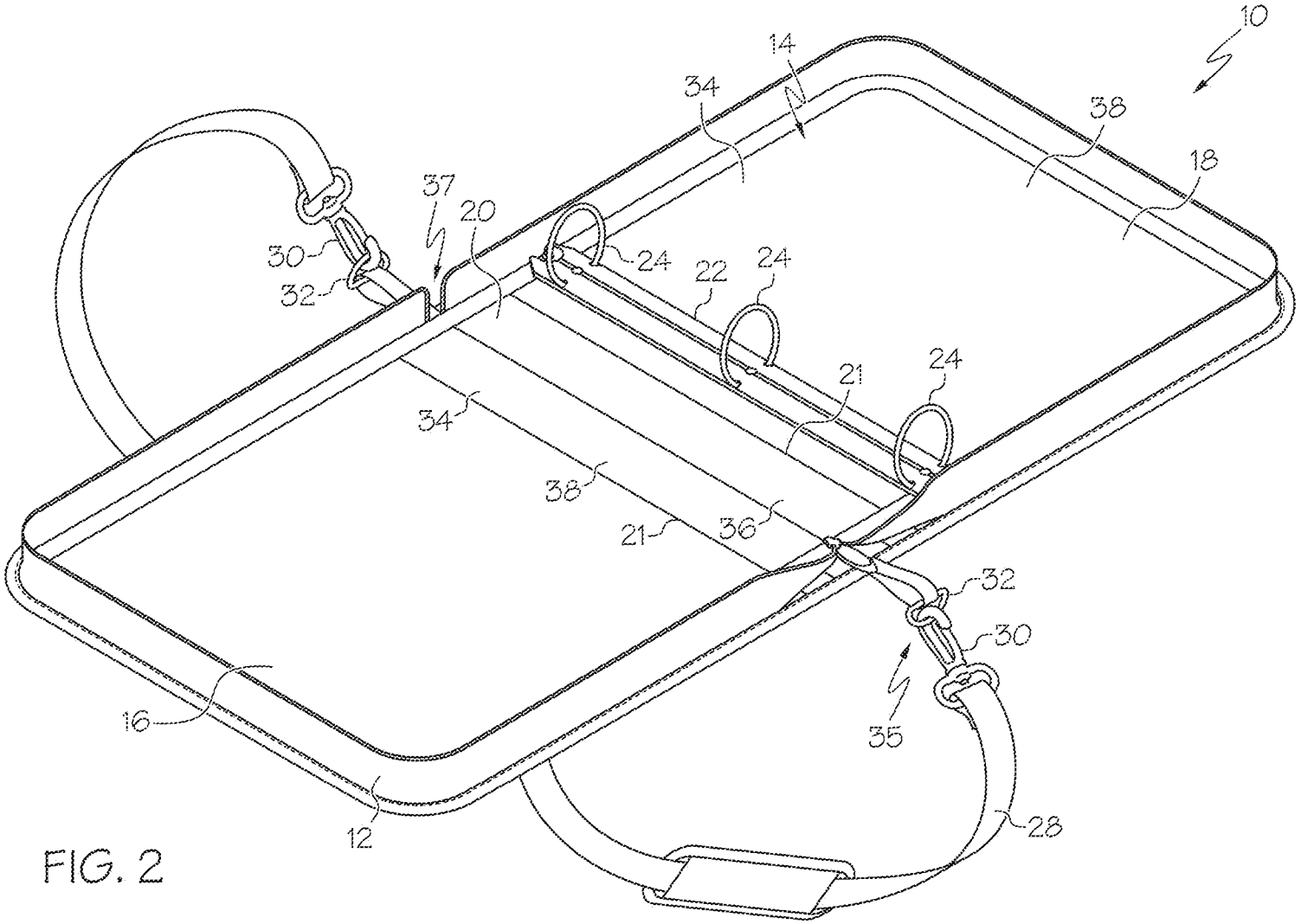
FIG. 2 is front perspective view of the storage device of FIG. 1 in its open position.

As shown in FIG. 2, the storage device 10 may also include a binding mechanism 22 coupled to an inner surface of the casing 12. In the illustrated embodiment the binding mechanism 22 takes the form of a three-ring binder or the like, including one or more binding rings 24. Each binding ring 24 may be separable into two separate ring halves or portions such that papers or other items can be bound to, or removed from, the binding mechanism 22. Each binding ring 24 may also be movable to a closed position (FIG. 2) in which the ring halves engage each other and form a closed ring to trap the bound contents therein. However, the binding mechanism 22 can take any of a variety of other forms or configurations besides ring binding mechanisms, such as a coil or wire bindings (including spiral and twin-wire bindings), clips, cords, ribbons, clamps, elastic connectors, adhesives, book-style bindings, and combinations thereof.

The binding mechanism 22 can be positioned in the inner compartment 14 such that various bound items can be positioned in the inner compartment 14. In addition, various pockets or the like can be positioned in the inner compartment 14 or items can be loosely positioned in the inner compartment 14. The illustrated storage device 10 further includes a handle 26 positioned on an outer surface of the casing 12 to provide a convenient structure by which a user can carry the storage device 10. In one case the handle 26 provides or defines an opening through which a user can extend his or her hand to manually carry the casing 12. Moreover the storage device 10 need not necessarily include a binding mechanism 22 and need not take the form of a binder. The storage device 10 could instead take the form of, for example, a bag, pocket, pouch, briefcase etc., or nearly any component capable of being carried and storing items therein.

Figure 3:
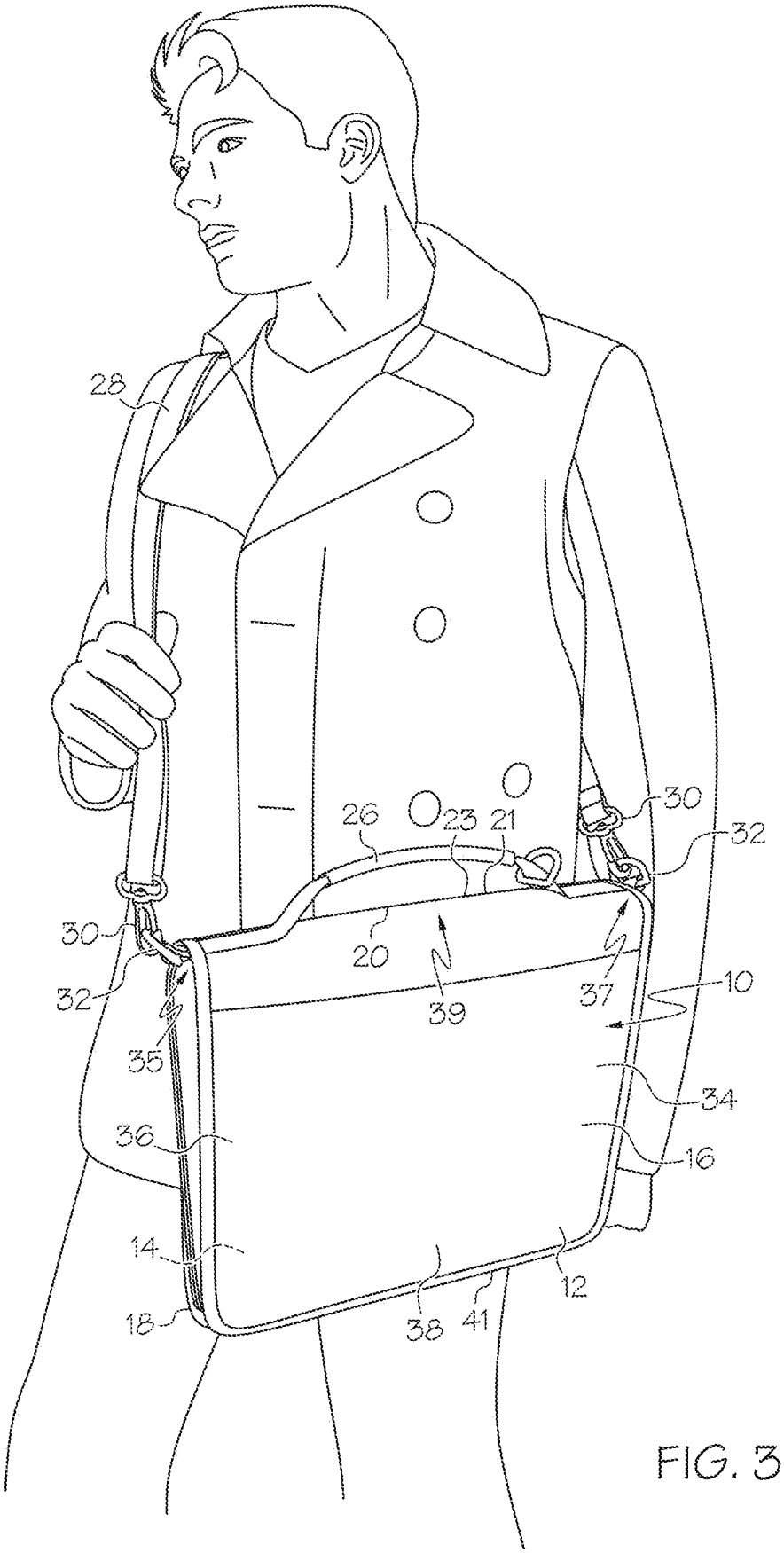
FIG. 3 is a front perspective view of the storage device of FIG. 1 being worn as a courier-type bag.
Figure 8:
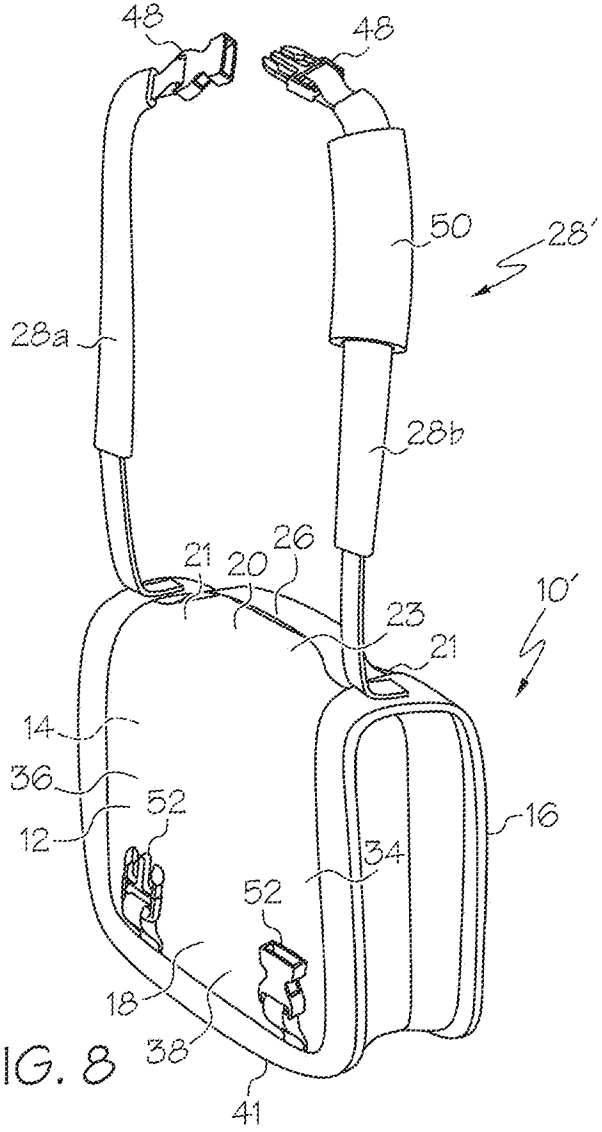
FIG. 8 is a rear perspective view of the storage device of FIG. 7 in its closed position with the strap disconnected.
Figure 7:
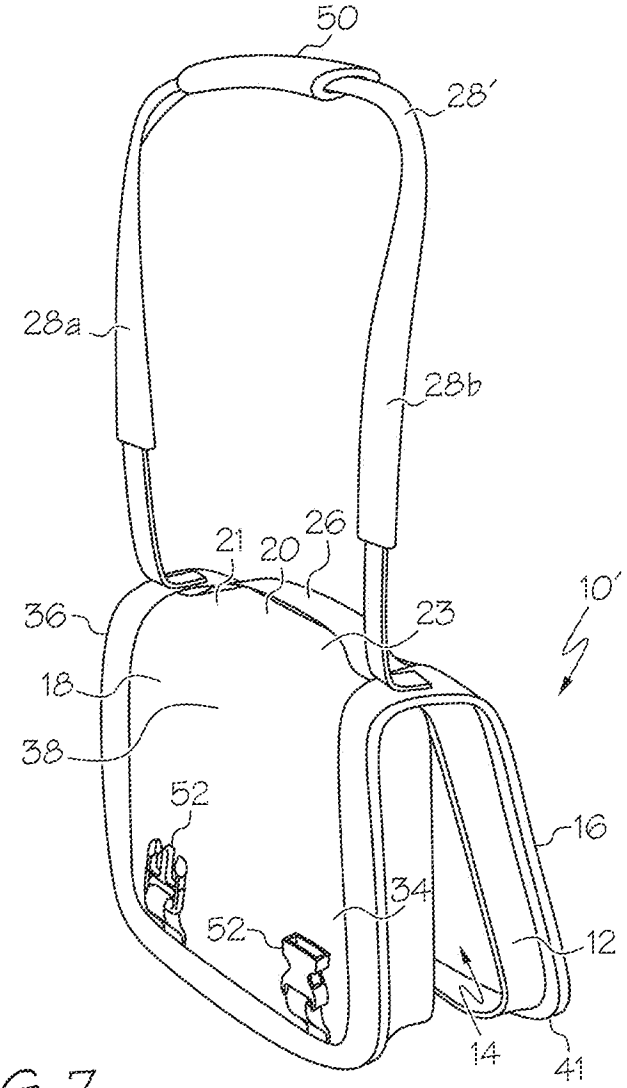
FIG. 7 is a rear perspective view of another embodiment of the storage device in its partially open position with the strap in its first configuration.
Figure 9:
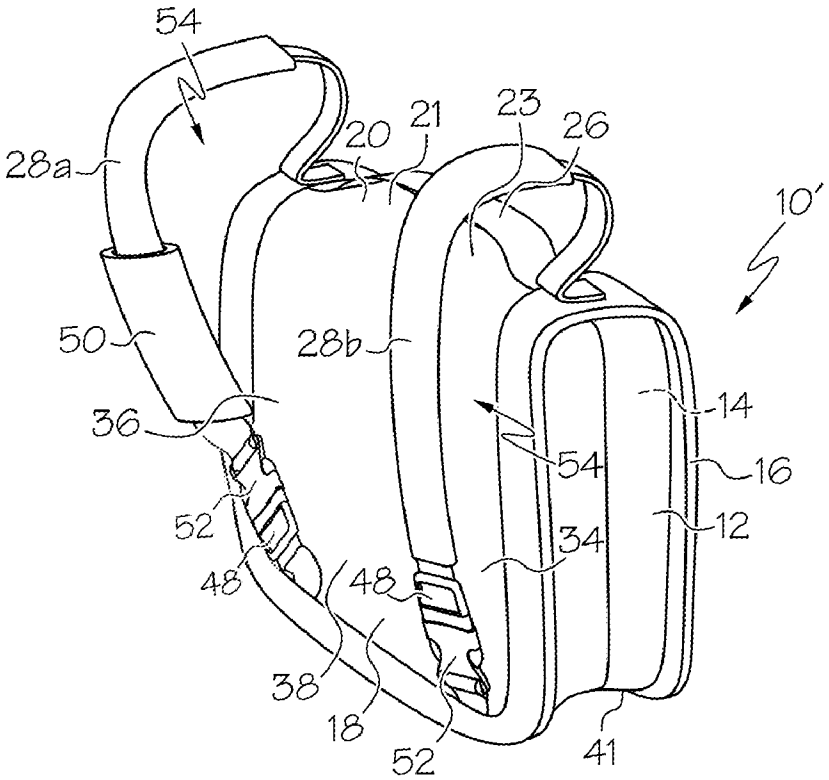
FIG. 9 is a rear perspective view of the bag of FIG. 8, with strap in its second configuration.

The storage device 10 also includes a carrying strap 28 that can be of a fixed or adjustable length and can be arranged in various configurations. The strap 28 can take the form of a longitudinally extending piece of material made of the same or different materials than the casing 12. In the embodiment of FIGS. 1-3, the distal ends of the strap 28 are releasably secured to the casing 12 by a set of clasps 30 which are secured to the strap 28. Each clasp 30 can then be removably passed through a corresponding loop 32 which is secured to the casing 12. However the distal ends of the strap 28 could instead be permanently attached to the casing 12, as shown in the embodiment of FIGS. 7-9, such as by stitching or the like, or releasably attached by structure other than the illustrated clasps 30/loops 32. Thus in at least one embodiment the distal ends of the strap 28 are fixedly, and not slidably or movably, coupled to the casing 12 in a manner described below. In one case the strap 28 is a single, continuous strap or piece of material, is and not separable into separate strap portions as contrasted with the strap 28' of, for example, FIG. 8. In one case the loops 32 are positioned along or adjacent to a top edge 23 of the casing 12.

The strap 28 is arranged in a first configuration in FIGS. 1-3 in which the strap 28 is secured to opposite, outer sides of the casing 12. When in the first configuration the strap 28/storage device 10 can be worn as a sling over a shoulder of a user and carried as courier-type bag, as shown in FIG. 3.

The storage device 10/casing 12 can be generally rectangular in front view, and in the first configuration the strap 28 is secured at or adjacent to first 34 and second 36 outer portions, respectively, which constitute left and right portions of the storage device 10/casing 12 in front view, between which is positioned a middle portion 38. Although the dimensions and delineations of the outer 34, 36 and middle 38 portions can vary, in one case each outer portion 34, 36 comprises an outer 25% of the length (extending laterally, in a generally left-to-right direction in FIG. 3) of the storage device 10/casing 12 in front view, and the middle portion 38 comprises the middle 50% of the length of the storage device 10/casing 12 in front view. In the illustrated embodiment the strap 28, when in the first configuration, is secured only at its ends and/or only to the first 34 and second 36 outer portions, and the strap 28 is not secured to the middle portion 38 thereof.

The storage device 10 can include a strap securing device 40 and a body securing device 42 which are releasably attachable together to thereby releasably attach the strap 28 to the casing 12, and more particularly in one case to the middle portion 38. The strap securing device 40 is positioned on or coupled to the strap 28, and in the illustrated embodiment takes the form of a hook or clasp 40 coupled to a loop 44 that is slidable along a length of the strap 28 (in one case slidable along at least about 50% of a length of the strap 28, or in another case a distance equal to at least about 50% of the length of the casing 12). The illustrated body securing device 42 is positioned on or coupled to the casing 12, and more particularly the handle 26 in the embodiment of FIGS. 1-5. The body securing device 42 can be slidable along a length of the handle 26 (in one case along at least about 50%, and in another along at least about 90%, of a length of the handle 26), and takes the form of a loop 42 in the illustrated embodiment. In one case the body securing device 42 is not slidable, and is instead fixed to the handle 26 and/or casing 12, With reference to FIG. 3, the casing 12 can have a length dimension (extending generally in a left-to-right direction), a height dimension (extending generally vertically) and a thickness dimension (extending generally into and out of the page of FIG. 3). The strap 28, when in the first configuration, can be configured to extend across substantially an entirety of the length dimension of the casing 12 (e.g. at least about 90% of the length dimension in one case). The strap 28 is coupleable to the outer portions 34, 36 at first 35 and second 37 attachment locations, respectively, and is coupleable to the middle portion 38 at a third attachment location 39. In one case the first 35, second 37 and third 39 attachment locations are all in the same half of the height of the casing 12, and more particularly in an upper portion or half of a height of the casing 12. In yet another embodiment, the first 35, second 37 and third 39 attachment locations are all located relatively close to each other in the height direction, e.g. within at least about 25% in one case, or at least about 10% in another case, of a height of the casing 12.

Figure 4:
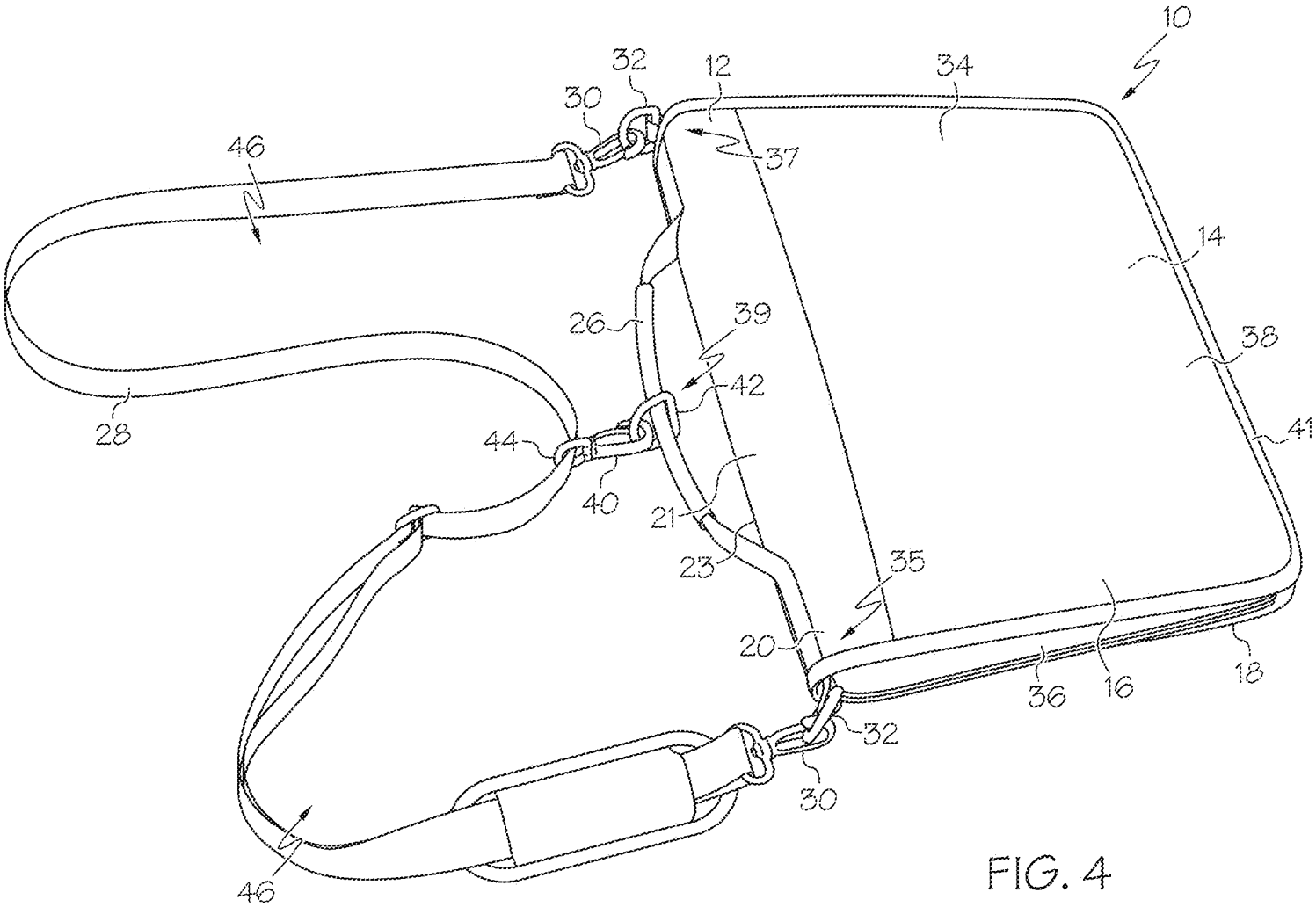
FIG. 4 is a front perspective view of the storage device of FIG. 1 with the strap in a second configuration.

The strap 28 can be moved to its second configuration by releasably securing the strap 28 to the casing 12, such as by connecting the strap securing device 40 to the body securing device 42, as shown in FIG. 4. In the illustrated embodiment the strap securing device 40 is secured to the body securing device by passing the securing device 40 through the loop 42. However, the position of the securing device 40 and loop 42 can of course be reversed, and moreover any of a wide variety of other structures and mechanisms can be used to secure the strap 28 and casing 12, such as zippers, hooks, buckles, brackets, hook-and-loop fastening material (such as VELCRO®), ties, inter-engaging shapes, magnets etc.

Figure 5:
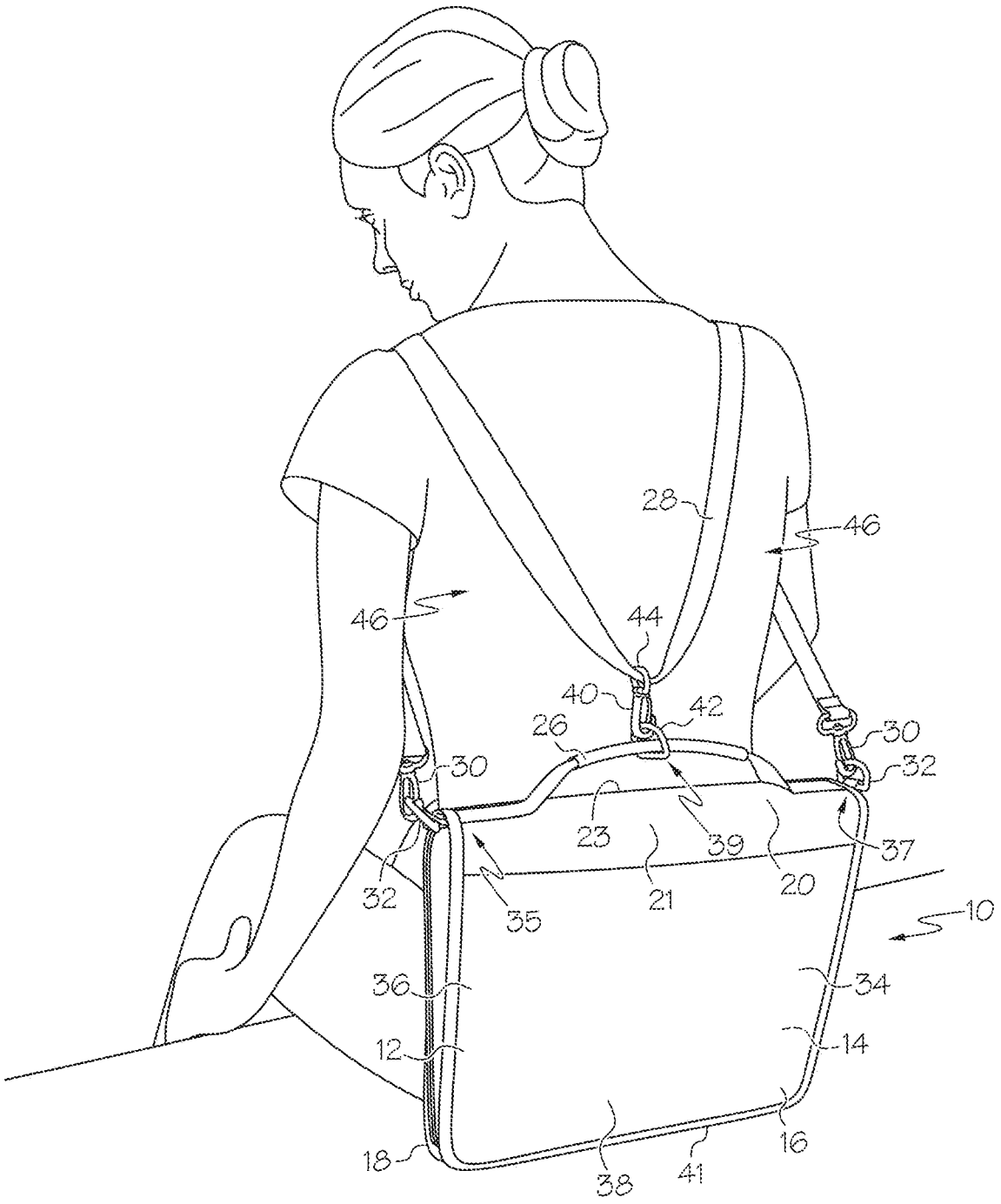
FIG. 5 is a front perspective view of the storage device of FIG. 4 being worn as a backpack-style bag.

When the strap 28 is secured to the casing 12 in its second configuration, the strap 28 is thereby secured to the middle portion 38 of the casing 12 and the strap 28 at least partially defines a pair of loops 46. Each loop 46 is shaped and configured to receive an arm of a wearer therethrough such that the storage device 10 can be carried on a back of the wearer in the manner of a backpack, as shown in FIG. 5 and in which case part of the loops 46 can be defined by the casing 12. When the strap 28 is in the first configuration the strap 28/casing 12 does not define the pair of loops 46. The strap 28 can be positioned entirely externally of the inner compartment 14 when in either the first configuration or the second configuration.

In the particular embodiment of FIGS. 1-5, both the strap securing device 40 and the body securing device 42 are slidable. This configuration can be useful to enable those components to automatically adjust to the position desired by the wearer, providing flexibility to adjust to various weight distributions, and to adjust laterally along the back of a wearer when, for example, a wearer leans against wall or is in a crowded location such as a bus or subway, etc. However, it is not required that the strap securing device 40 and the body securing device 42 both be slidable, and indeed one or both of those component can be configured in a fixed and non-slidable manner. For example, in the embodiment of FIG. 6 the body securing device 42 is generally fixedly and non-slidably secured to the casing 12.

Figure 6:
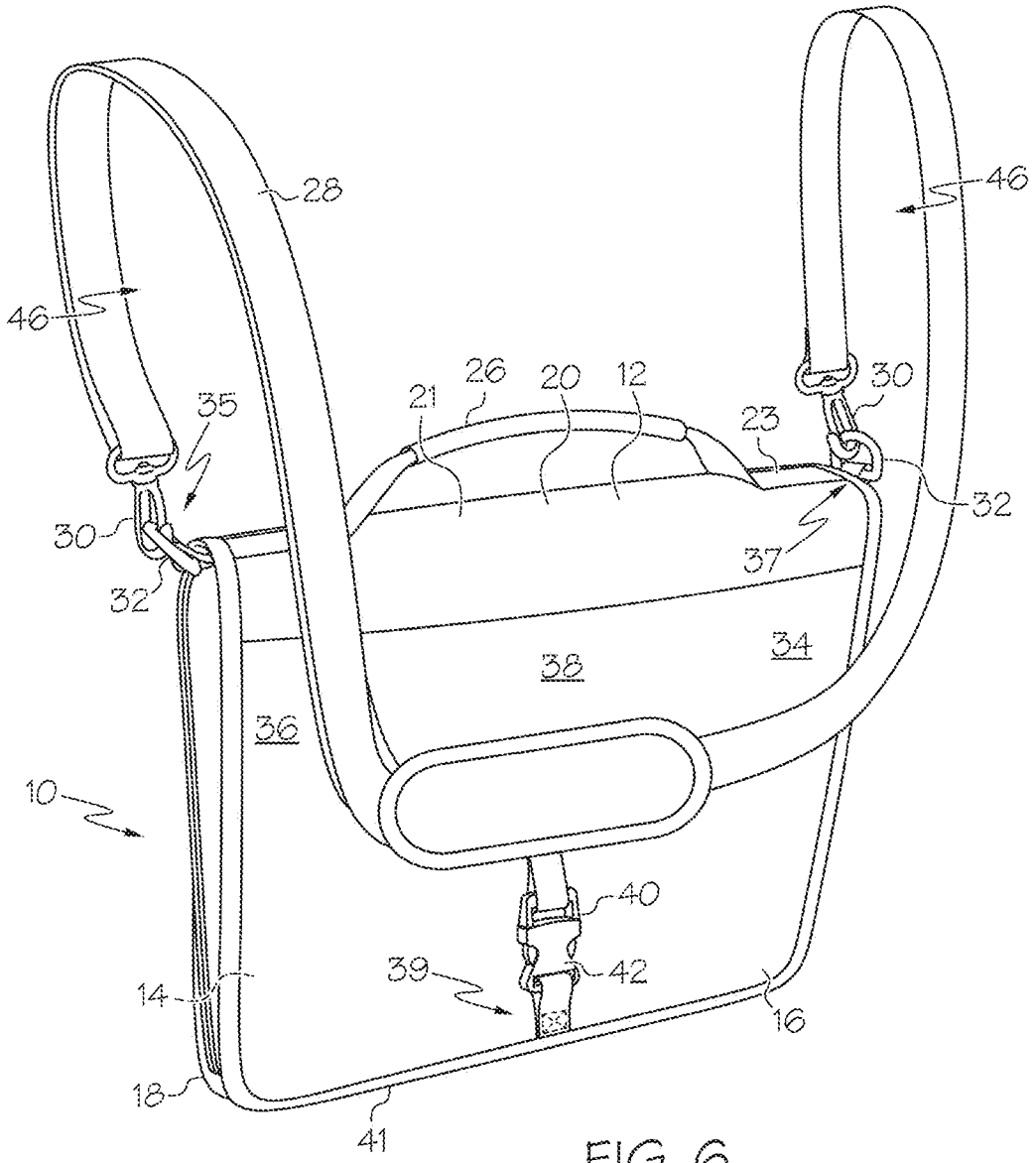
FIG. 6 is a front perspective view of another embodiment of the storage device with the strap in its second configuration.

It should also be understood that the body securing device 42 can be positioned at a variety of locations on the casing 12, and need not necessarily be positioned on the handle 26. For example, in the embodiment shown in FIG. 6 the body securing device 42 is positioned on a lower portion of the casing 12, spaced away from the handle 26. In one case, the body securing device 42 is positioned in a center of the casing 12, with respect to a length thereof (left-to-right direction), to provide balanced and centered shoulder straps or loops 46. As shown in FIG. 6, when strap 28 is secured to the middle portion 38 at the third attachment location 39, the third attachment location 39/body securing device 42 can be spaced away from an upper edge 23 of the casing 12, and in one case be positioned along or adjacent to a bottom edge 41 of the casing 12. This arrangement can help to ensure that when the casing 12 is worn as a backpack the casing 12 is positioned adjacent a back of the wearer, instead of hanging down low below the back of the wearer.

FIGS. 7-9 illustrate an alternative embodiment of the storage device 10' wherein the strap 28' includes a first strap segment **28*a* and a second strap segment 28*b* that are releasably attachable together. Each strap segment 28*a* is coupled to the casing 12 at a base end and has a free distal end that are attachable together. A strap segment attachment device 48, such as part of a clasp in the illustrated embodiment, is positioned at the distal end of each strap segment 28***a*, 28*b*. The strap segment attachment devices 48 are releasably attachable together to attach the strap segments 28*a*, 28*b* at their distal ends to form a continuous strap 28', as shown in FIG. 7. In this configuration the strap 28' can be worn as a sling over a shoulder of a user and worn as courier-type bag in the same manner as shown in FIG. 3. The strap 28' can also include a sleeve 50 that is slidably mounted on the strap 28', and can slide over and cover the strap segment attachment devices 48 when attached together, as shown in FIG. 7.

The strap 28' is also movable to a second configuration wherein each strap segment 28*a*, 28*b* is individually releasably attached to the casing 12, and more particularly to an outer portion 34, 36 of the casing 12 in one case. In particular, as shown in FIGS. 8 and 9 the strap segments 28*a*, 28*b* can be detached from each other and then releasably attached to the casing 12. The casing 12 may carry body securing devices 52, which are releasably securable with the associated strap segment attachment devices 48, as shown in FIG. 9.

In this configuration each strap segment 28*a*, 28*b* is releasably attached to the casing 12 at their distal ends to form a pair parallel of strap loops 54. Each strap loop 54 is shaped and configured to receive an arm of a user therethrough such that the storage device 10' can be carried on a back of the wearer in the manner of a backpack, analogous to the configuration shown in FIG. 5.

In the illustrated embodiment, one of the body securing devices 52 (the left body securing device 52, in the illustrated embodiment) has a male configuration, configured to be coupled to the corresponding strap segment attachment device 48 (the female strap segment attachment device 48, on the left in FIG. 8). Correspondingly, the other one of the body securing devices 52 (the right body securing device 52, in the illustrated embodiment) has a female configuration, configured to be coupled to the corresponding strap segment attachment device 48 (the male strap segment attachment device 48, on the right in FIG. 8). In this case each body securing device 52 is configured to be coupled only to a corresponding strap segment 28*a*, 28*b*, and is configured to not be coupleable to the non-corresponding strap segment 28*a*, 28*b*. This arrangement ensures that the strap segments 28*a*, 28*b* are secured by a user only in their proper backpack configuration, and are not inadvertently crossed and secured in place.

In this manner the storage device 10, 10' can be arranged in various different configurations to be carried in different manners. This provides great flexibility to allow the storage device 10 to be configured and carried as desired, and the reconfiguration process is intuitive and easy to implement.

Having described the invention in detail and by reference to the various embodiments, it should be understood that modifications and variations thereof are possible without departing from the scope of the invention.

What is claimed is:

1. A binder device comprising:

a body having a first cover and a second cover directly or indirectly pivotally coupled together along a spine and configured to at least partially define an inner compartment therebetween, wherein the body further includes a binding mechanism including binding rings which can bind papers or other items thereto positioned in the inner compartment, wherein a handle portion is positioned on the spine;

a first body securing device coupled to the body;

a second body securing device coupled to the body; and a strap including first and second strap segments, wherein the first strap segment is releasably coupled to said body at or adjacent to said spine at a first strap attachment location, wherein the second strap segment is releasably coupled to said body at or adjacent to said spine at a second strap attachment location, and wherein the first and second strap attachment locations are spaced apart from the handle portion on opposite sides thereof;

wherein the strap is movable between a first configuration wherein the first and second strap segments are releasably coupled together to form a continuous strap that is wearable over a shoulder of a user, and a second configuration wherein the first strap segment is releasably coupled the first body securing device and the second strap segment is releasably coupled to the second body securing device such that the first and second strap segments each at least partially defines a loop, each loop being shaped and configured to receive an arm of a user therethrough such that the binder device is wearable on a back of the user in the manner of a backpack, wherein each strap segment is configured to be releasably coupled to only one of the first or second body securing devices.

2. The binder device of claim 1 wherein the first strap segment is configured to be releasably coupled to the first body securing device and is configured to not be releasably coupled to the second body securing device, and wherein the second strap segment is configured to be releasably coupled to the second body securing device and is configured to not be releasably coupled to the first body securing device, and wherein the first and second strap segments are directly releasably coupled together when said strap is in said first configuration.

3. The binder device of claim 1 wherein the first strap segment is releasably coupled at the first strap attachment location via a ring and closed hook and the second strap segment is releasably coupled at the second strap attachment location via a ring and closed hook.

4. The binder device of claim 3 wherein the first and second strap segments are each individually releasably attachable at distal ends thereof to an associated body securing device to form the loops when the strap is in the second configuration.

5. The binder device of claim 1 wherein the first and second strap segments are configured such that when the strap is in the second configuration one of the loops is positioned on a first outer portion of the body and the other loop is positioned on a second outer portion of the body spaced away from the first outer portion in a lateral direction parallel to the spine.

6. The binder device of claim 1 wherein a distance between said first and second attachment locations extends across substantially an entirety of a length of the binder device in a direction parallel to the spine.

7. The binder device of claim 1 wherein the first strap segment has a first strap segment securing device coupled thereto at a distal end thereof, wherein the second strap segment has a second strap segment securing device coupled thereto at a distal end thereof, wherein the first strap segment device is configured to be releasably coupled to the first and not the second body securing device, wherein the second strap segment device is configured to be releasably coupled to the second and not the first body securing device.

8. The binder device of claim 7 wherein one of the strap segment securing devices is a male strap segment securing device and the other one of the strap segment securing devices is a female strap segment securing device, and wherein one of the body securing devices is a male body securing device and the other one of the body securing devices is a female body securing device.

9. The binder device of claim 1 wherein each of the first and second strap segments includes a base end, and wherein the base end of both of the first and the second strap segments is directly coupled to the spine.

10. The binder device of claim 9 wherein the first and second body securing devices are both positioned at or adjacent to a distal end of one of the first or second covers, opposite the spine.

11. The binder device of claim 9 wherein the first and second strap segments are both removably coupleable to the spine.

12. The binder device of claim 9 wherein the base ends of both the first and the second strap segments are not directly coupled to the handle portion.

13. The binder device of claim 1 wherein the strap, when in the first configuration, has opposite ends that are attachable to opposite ends of the body.

14. The binder device of claim 1 further comprising a sleeve slidably coupled to at least one of the first or second strap segments, wherein when the strap is in the first configuration the first and second strap segments are releasably coupled to together at an attachment point, and wherein the sleeve is slidable to a position wherein the sleeve spans the attachment point.

15. The binder device of claim 1 wherein the binding mechanism is positioned on or immediately adjacent to said spine.

16. The binder of claim 1 wherein the body is generally shaped as a rectangle in top view, and wherein the binder further includes a releasable fastener extending along three sides of said rectangle to thereby releasably attach said first and second covers.

17. A binder device comprising:

a body having a first cover and a second cover directly or indirectly pivotally coupled together along a spine and configured to at least partially define an inner compartment therebetween, wherein the body further includes a binding mechanism including binding rings which can bind papers or other items thereto positioned in the inner compartment, wherein a handle portion is positioned on the spine;

a male body securing device coupled to the body;

a female body securing device coupled to the body;

a first strap segment having a female strap securing device at an end thereof, wherein the first strap segment is releasably coupled to said body at or adjacent to said spine at a first strap attachment location; and a second strap segment having a male strap securing device at an end thereof, wherein the second strap segment is releasably coupled to said body at or adjacent to said spine at a second strap attachment location;

wherein the first and second strap attachment locations are spaced apart from the handle portion on opposite sides thereof; and wherein the female strap securing device of the first strap segment is releasably coupleable to the male strap securing device of the second strap segment to thereby releasably couple the first strap segment and the second strap segment together to form a single strap that is coupleable to the body and wearable over a shoulder of a user, wherein the female strap securing device of the first strap segment is releasably coupleable to the male body securing device such that that first strap segment forms a loop with the body, and wherein the male strap securing device of the second strap segment is releasably coupleable to the female body securing device such that the second strap segment forms a loop with the body, each loop being shaped and configured to receive an arm of the user therethrough such that the binder device is wearable on a back of the user in the manner of a backpack.

18. The binder device of claim 17 wherein the first strap segment and the second strap segment are both permanently attached to the body at or adjacent to the spine.

19. A method for using a binder device comprising:

accessing a binder device including:

a body having a first cover and a second cover directly or indirectly pivotally coupled together along a spine and at least partially defining an inner compartment therebetween, wherein the body further includes a binding mechanism including binding rings which can bind papers or other items thereto positioned in the inner compartment, wherein a handle portion is positioned on the spine;

a first body securing device coupled to the body;

a second body securing device coupled to the body; and a strap including first and second strap segments, wherein the first strap segment is releasably coupled to said body at or adjacent to said spine at a first strap attachment location, wherein the second strap segment is releasably coupled to said body at or adjacent to said spine at a second strap attachment location, and wherein the first and second strap attachment location are spaced apart from the handle portion on opposite sides thereof, wherein the first and second strap segments are configured to be releasably coupled together, and wherein each strap segment is configured to be releasably coupled to only one of the first or second body securing devices; and moving the strap to or from a first configuration, wherein the first and second strap segments are releasably coupled together to form a continuous strap that is wearable over a shoulder of a user, from or to a second configuration wherein the first strap segment is releasably coupled the first body securing device and the second strap segment is releasably coupled to the second body securing device such that the first and second strap segments each at least partially defines a loop, each loop being shaped and configured to receive an arm of a user therethrough such that the binder device is wearable on a back of the user in the manner of a backpack.

20. The binder of claim 16 wherein the body includes a first gusset oriented generally perpendicular to the first cover and extending along said three sides of said rectangle, and a second gusset oriented generally perpendicular to the second cover and extending along said three sides of said rectangle, and wherein said releasable fastener releasably attaches said first and second gussets.

* * * * *